US006113670A

United States Patent [19]

Nealon et al.

[11] Patent Number: 6,113,670

[45] Date of Patent: Sep. 5, 2000

[54] TWIN CHAMBER COMBUSTION FURNACE

[75] Inventors: Robert J. Nealon; Joseph E. Danega, both of Victorville, Calif.

[73] Assignee: Thermtronix Corporation, Adelanto, Calif.

[21] Appl. No.: 09/054,609

[22] Filed: Apr. 3, 1998

[51] Int. Cl.[7] ..... C22B 21/00

[52] U.S. Cl. ..... 75/686; 266/212

[58] Field of Search ..... 266/200, 212; 75/686, 687, 585, 588

[56] References Cited

U.S. PATENT DOCUMENTS

| | | | |
|---|---|---|---|
| 126,709 | 5/1872 | Johnston | 266/212 |
| 1,671,546 | 5/1928 | Romph . | |
| 1,818,812 | 8/1931 | Musso . | |
| 2,035,282 | 3/1936 | Schmeller, Sr. | 266/212 |
| 2,402,498 | 6/1946 | Kohlhepp . | |
| 3,231,253 | 1/1966 | Thompson | 266/212 |
| 3,247,555 | 4/1966 | Keating . | |
| 4,353,532 | 10/1982 | Jay . | |
| 4,589,634 | 5/1986 | Bleickert . | |
| 4,664,702 | 5/1987 | Barnes et al. . | |
| 4,712,774 | 12/1987 | Louis . | |
| 4,884,426 | 12/1989 | Schwarz . | |
| 4,989,841 | 2/1991 | Tokumasu et al. . | |
| 5,120,027 | 6/1992 | Pelton . | |

*Primary Examiner*—Scott Kastler

[57] ABSTRACT

Refractory lined metal melting furnace for the melting and holding a plurality molten metals or alloys of different composition comprises a melting chamber, a plurality of passages communicating the melting chamber to a plurality of refractory lined, heated holding chambers for holding individual molten metals or alloys therein. The holding chambers are separated from one another by a refractory partition to thereby eliminate contact between molten metals or alloys therein. The holding chambers are selectively communicated one at a time to the melting chamber to introduce a respective molten metal or alloy to respective holding chamber. The holding chambers are communicated to respective take-out wells where each respective individual molten metal or alloy is received without contact with the others for further processing or removal.

14 Claims, 5 Drawing Sheets

TWIN CHAMBER COMBUSTION FURNACE

FIELD OF THE INVENTION

This invention relates generally to the art of metal (e.g. aluminum) melting and in particular to non-crucible refractory lined furnaces using fossil fuels and combustion processes as their primary source of energy.

BACKGROUND OF THE INVENTION

One prior art apparatus is a reverberatory type furnace which simply passes the combustion heat through, or over the top of the solid metal charge material before exiting a flue in the roof. This apparatus makes very minimum use of the combustion energy. This apparatus also directs the combustion flame at an internal refractory wall. This apparatus is not wholly satisfactory, however, because it requires the furnace melting chamber be completely shut down to repair or service any damage done to the internal walls by the combustion flame. Additionally this apparatus makes no provision to allow for the holding or storage of more than one molten metal alloy. The entire molten metal bath must be drained and the walls and floor cleaned, to prevent metallurgical contamination, before filling with a different molten metal alloy.

Another type of prior art apparatus is a non-crucible refractory lined furnace that uses a vertical shaft, or stack in which to place solid metal charge material. Combustion energy is applied at the base of the vertical shaft and causes the metal to melt as the heat passes up through the metal charge to exit a flue in the roof. This apparatus requires the solid metal charge material be placed in the top of the furnace and does not allow for placing large stacks of ingot, or sows on the floor of the furnace with a forklift, or other mechanized device. This apparatus also directs the combustion flame at an internal refractory wall. This is not wholly satisfactory, however, because it requires the furnace melting chamber be completely shut down to repair or service any damage done to the internal walls by the combustion flame. Additionally this apparatus makes no provision to allow for the holding or storage of more than one molten metal alloy. The entire molten metal bath must be drained and the walls and floor cleaned, to prevent metallurgical contamination, before filling with a different molten metal alloy.

SUMMARY OF THE INVENTION

It is an object of the present invention to provide a non-crucible refractory lined metal melting furnace that allows for the sequential melting and simultaneous holding, storage and use of more than one molten metal or alloy in a single furnace without metallurgical contamination.

A further object of the invention is to provide a melting furnace that allows the user to maintain and use molten metal baths of two or more metals or alloys at one time in a single furnace without the problem of alloy contamination.

A further object of the present invention is to provide a melting furnace that makes more efficient use of combustion energy by forcing energy to circulate through the solid metallic charge in a primary melt chamber before entering a bottom pass-through from which the energy enters a secondary melting chamber which is an integral part of the furnace.

A still further object of the present invention is to provide a melting furnace with an integral secondary melting chamber which receives heat through a bottom pass-through from a primary melt chamber where solid metal charge material is placed in the secondary melt chamber through an access door. Combustion heat rising through the secondary melt chamber is absorbed by the solid metal charge material therein, resulting in supplemental melting of the charge material before exiting the secondary melt chamber.

Yet another object of the invention is a melting furnace having a primary melt chamber combustion burner, or burners, directed at a removable refractory lined access door which will allow the user to easily replace or repair the access door, as necessary, without the need for a prolonged shutdown of the furnace.

How these and other objects of the present invention are accomplished will be described in detail in the following specification taken in conjunction with the drawings. An illustrative embodiment of the invention comprises a refractory lined steel or other structure forming a furnace comprising a primary melt chamber with a fuel fired combustion system and in which solid metal charge material is placed. The primary melt chamber has a removable refractory lined door toward which the combustion energy is directed by one or more fuel burner(s) and a bottom pass-through passage which exhausts heat to a secondary melt chamber in which additional solid metal charge material is also placed, to absorb heat and provide secondary melting before allowing exhaust heat to exit a flue in the roof of the secondary melt chamber. The furnace includes multiple holding chambers, which may be heated with an electric or fossil fuel fired energy source, isolated from one another for holding and storing a plurality of molten metals or alloys out of contact with one another. The holding chambers are communicated to the primary melting chamber via respective refractory lined pass-through passages which are blocked by removable plug(s) or other melt flow directing means as necessary to communicate one holding chamber at a time to the primary melting chamber in which an individual metal or alloy is melted.

DESCRIPTION OF A PREFERRED EMBODIMENT

Although the invention will be described hereafter for purposes of illustration with respect to melting of aluminum and its alloys, the invention is not so limited and can be practiced to melt, hold, store and use a wide variety of other metals and alloys. In the claims which follow below, the term molten metal is intended to include a metal and a metal alloy comprising two or more metals and/or other alloying elements.

Figure 1:
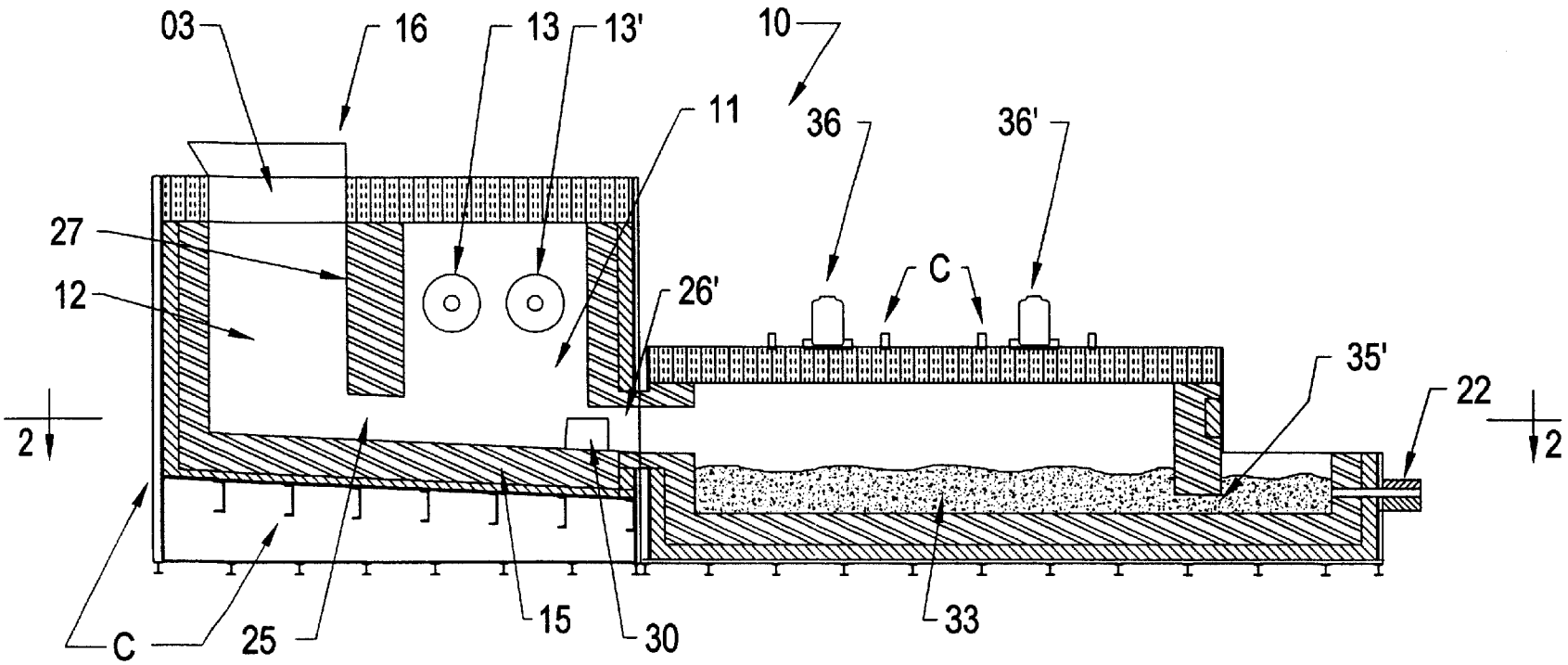
FIG. 1 is a longitudinal sectional view of an illustrative embodiment of the furnace of the present invention with a fossil fuel fired energy source to heat the holding well.

FIGS. 1–4 show an aluminum melting furnace 10 according to the present invention as generally including a one-half inch thick steel structure 14 reinforced with steel crossbeams and channels C and lined on the inside with refractory 15, such as conventional refractory brick and/or cast refractory lining material that can be both insulating and non-wetting to aluminum, a dry-hearth primary melt chamber 11, a dry-hearth secondary melt chamber 12 and a refractory wall 27 having a bottom pass-through passage 25 that allows heat to flow from the primary melt chamber 11 into the secondary melt chamber 12. A sealable refractory plug 30 or other molten metal flow directing means is positioned alternately in pass-through passages 26 or 26' to selectively communicate one holding chamber 19 or 19' at a time to the primary melting chamber 11. In FIG. 1, the plug 30 is shown blocking off the lower region of the pass-through passage 26' to the flow of melt, while preferably leaving a space at the upper region thereof for venting any excess pressure from the melting chamber 11 to the holding chamber 19'.

Figure 2:
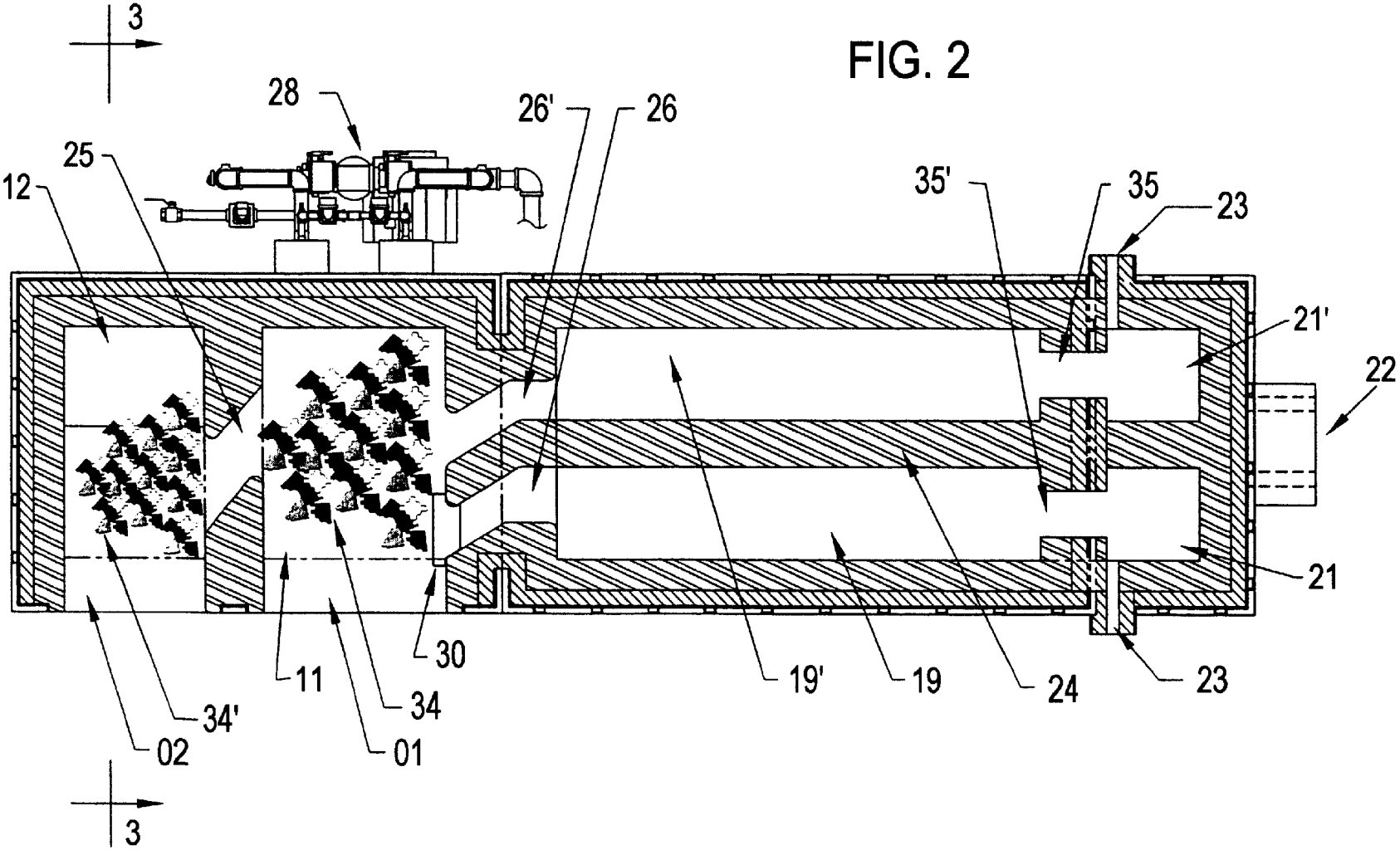
FIG. 2 is a sectional view of the furnace taken along lines 1—1 of FIG. 1.
Figure 3:
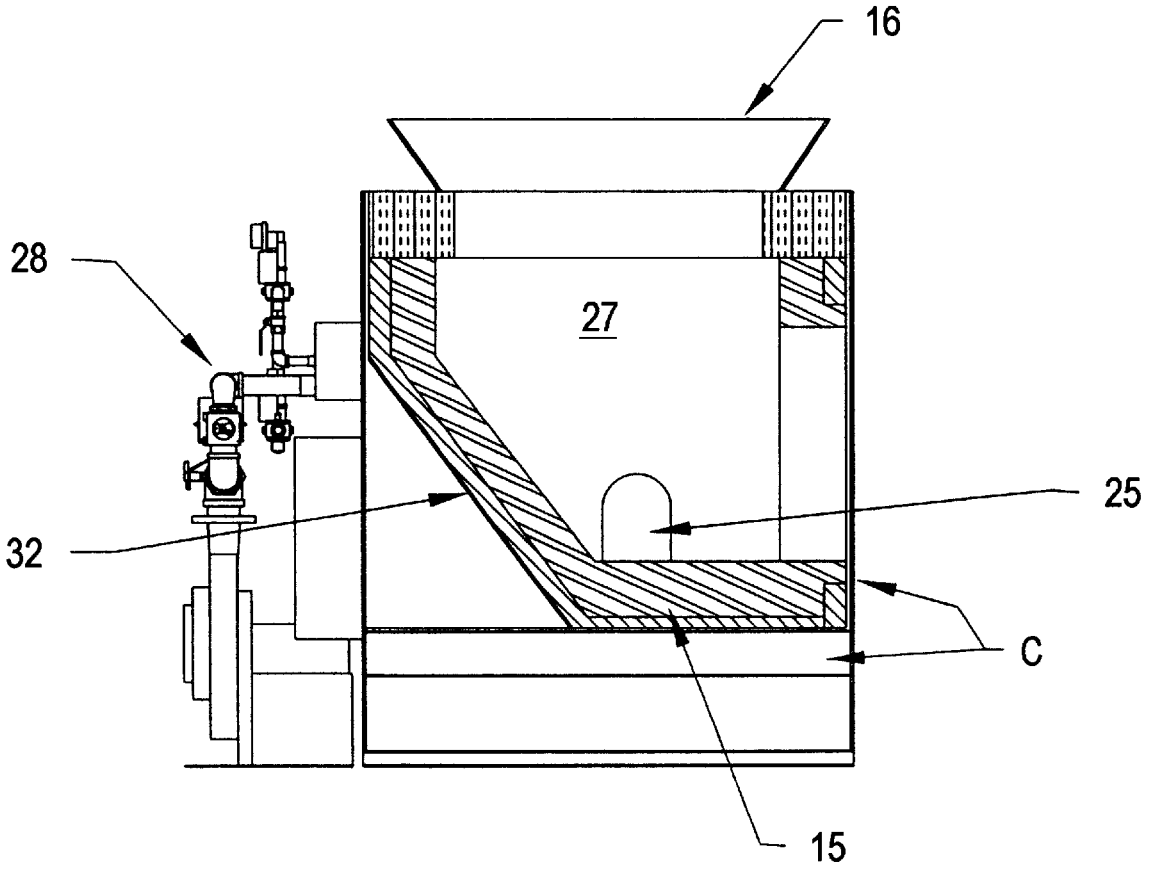
FIG. 3 is a sectional view of the furnace taken along lines 3—3 of FIG. 2.

The plug 30 in pass-through passage 26 of FIG. 2 permits molten metal (e.g. aluminum or its alloys) initially melted in the melting chambers 11 and 12 to enter holding chamber 19' and to prevent it from entering the holding chamber 19. Subsequently, a similar plug (not shown) is manually placed in pass-through 26' (with plug 30 removed from pass-through passage 26) to permit another molten aluminum alloy subsequently melted in the melting chambers 11 and 12 to enter holding chamber 19 and to prevent it from entering the previously filled holding chamber 19'. Other molten metal flow directing means in lieu of plug 30 for practicing the invention includes, but is not limited to, gate valve, stopper rod, a suitable contour or channel configuration imparted to the refractory floor of the melting chamber 11, a refractory member positioned on the floor of the melting chamber, and other molten metal flow directing devices positioned and/or opened/closed relative to respective pass-through passages 26 or 26' to selectively communicate one holding chamber 19 or 19' at a time to the primary melting chamber 11. A continuous refractory partition wall 24 dividing and isolating molten metal holding chamber 19 from chamber 19' prevents the molten metal contamination between the two holding chambers 19 and 19'. While the illustrated embodiment shows a single furnace 10 with one primary melt chamber 11, one secondary melt chamber 12 and molten metal holding chambers 19 and 19' to allow sequential melting and simultaneous holding and use of different metals or alloys, the furnace 10 may have additional separate primary melting chambers 11, secondary melting chambers 12 and holding chambers 19 and 19' within the scope of the invention.

The combustion system 28 includes one or more combustion burners 13 and 13' (e.g. conventional natural gas burners or oil, propane or other fuel burners) with the respective flames directly fired at a removable refractory lined (e.g. refractory brick-lined) door 17 providing access to the primary melt chamber 11. The door 17 is mounted on the exterior side of the furnace steel wall as shown in FIG. 4 for raising and lowering. The door 17 includes a pair of welded-on metal cylindrical pins 17A on opposite sides with the pins riding in respective tracks 17B formed on steel frame 21A welded to the steel furnace structure. The door 17 is raised and lowered by a fluid (e.g. hydraulic or pneumatic) cylinder HCl connected to the door pins 17A by cables C1 and associated pulleys P1, P2 on the frame 21*a*. A chain/sprocket door raising mechanism can be used in lieu of the cable/pulley mechanism shown. With the door 17 in the raised position, solid aluminum metal or alloy charge material 34 is placed through the access opening 01 in the furnace wall onto the refractory lined floor of the primary melt chamber 11, which is designed on a slight angle (e.g. 5 degrees) to direct molten metal toward the molten pass-through passages 26 and 26'. The door 17 is closed over the access opening by actuation of the fluid cylinder HC1 once the charge material is placed in chamber 11. One or more electrical motors (not shown) or any other actuator also may be used to raise/lower door 17.

As mentioned, the combustion burner, or burners, 13, 13' are directed at the refractory lined access door 17 which is readily removable form the furnace wall by lifting the door 17 off of the frame 21*a* to allow the user to easily replace or repair the door, as necessary, without the need for a prolonged shutdown of the furnace. The door 17 can be easily removed using a crane lift cable (not shown) connected to the eyelets shown in FIG. 4B located at the top of the door.

Figure 4A:
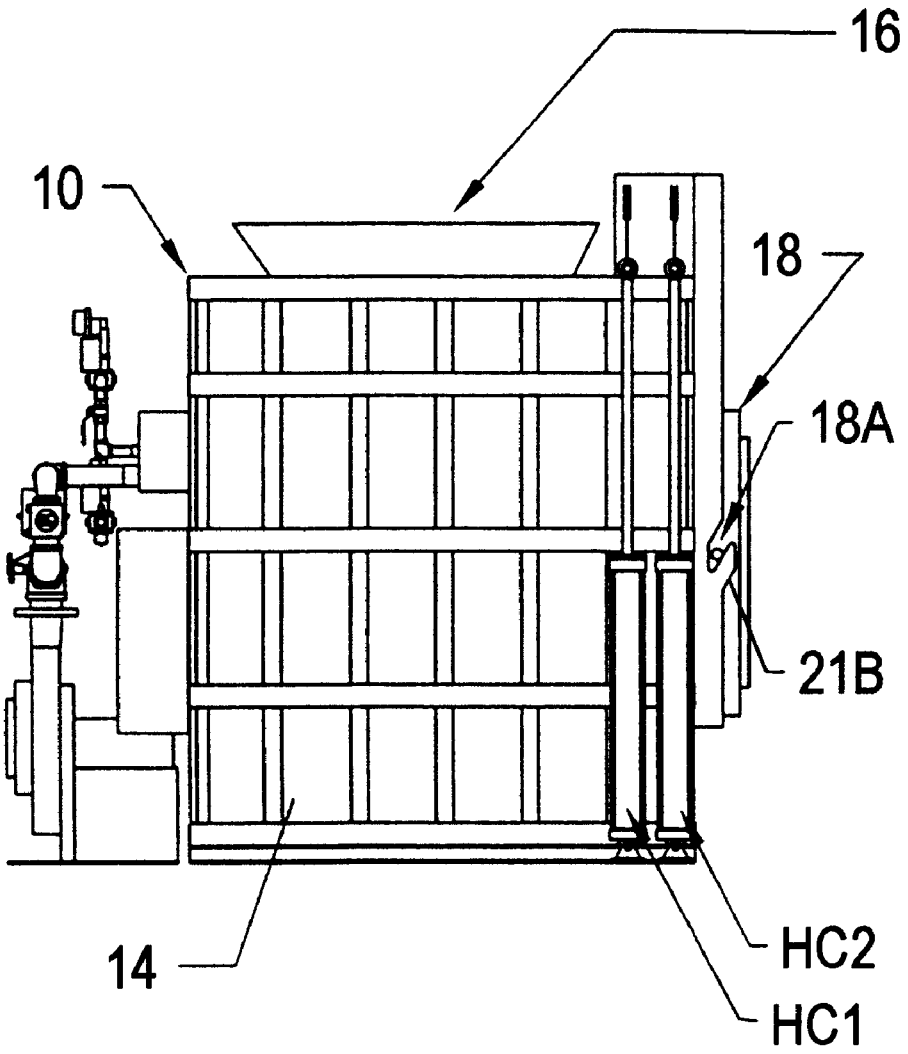
FIG. 4A is an end elevational view and FIG. 4B is a side elevational view of the furnace of FIGS. 1–3.
Figure 4B:
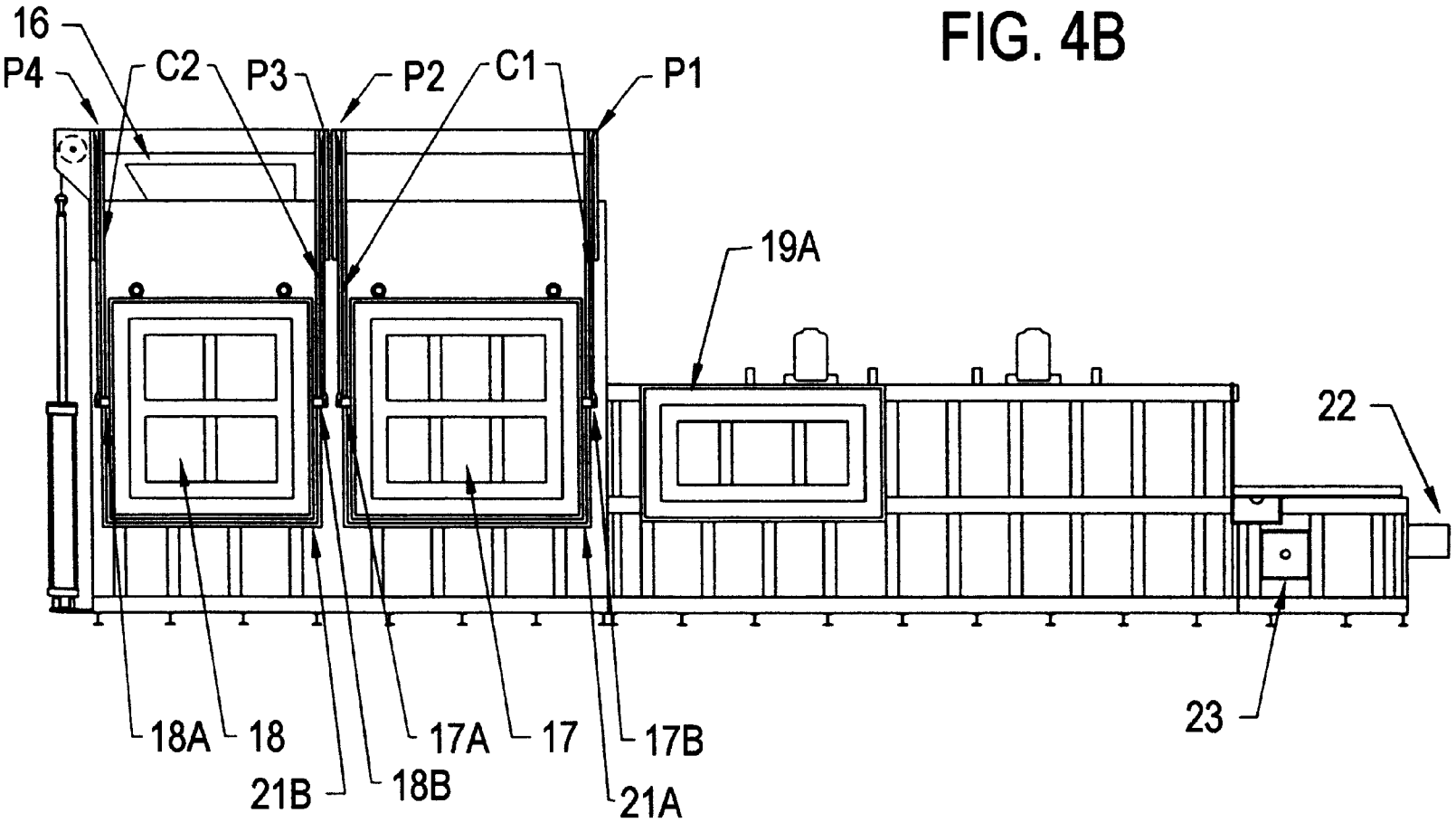

Additional solid aluminum metal or alloy charge material is placed in the secondary melt chamber 12, either from the side access door 18 or a top loading door 16. The side access door 18 is similar to door 17 in being mounted on the exterior side of the steel furnace wall as shown in FIGS. 4A, 4B for raising to expose access opening O2 and lowering to close off the opening. The door includes a pair of cylindrical welded-on pins 18A on opposite sides with the pins riding in respective tracks 18B formed on steel members 21B welded to the steel furnace structure. The door 18 is raised and lowered by a fluid (e.g. hydraulic or pneumatic) cylinder HC2 connected to the door 18 by cables C2 and associated pulleys P3, P4 on frame 21B. A chain/sprocket door raising mechanism can be used in lieu of the cable/pulley mechanism shown.

The top loading door 16 comprises a sliding, bin-shaped refractory-lined steel cover and is opened/closed relative to access opening 03 by a suitable fluid (e.g. hydraulic or pneumatic) cylinder or other actuator (not shown) connected thereto.

As combustion heat is applied from burner(s) 13, 13', it circulates through the solid aluminum charge material 34, FIG. 2, in the primary melt chamber 11 and is forced to enter the bottom pass-through 25 and into the secondary melt chamber 12. The combustion heat rises through the charge material 34' in the secondary melting chamber 12 to provide secondary melting and more efficient use of the energy. The rising heat exits melt chamber 12 via a conventional flue (not shown) located in the roof of the furnace.

When the solid charge material 34 begins to melt, the tapered refractory plug 30 properly sized and positioned in either molten metal pass-through passage 26 or 26' will prevent molten metal or alloy 33 from flowing into the corresponding holding chamber 19, 19'. A high temperature moldable joint compound, such as commercially available Fibratec moldable pump mix, or other seal material may be used to help maintain a good molten metal tight seal between the refractory plug 30 and the associated molten metal pass-through passage 26 or 26'. For example, as shown in FIG. 2, molten metal or alloy will be directed to flow from the melting chambers 11, 12 through the unplugged molten metal pass-through passage 26' into holding chamber 19' when the plug in pass-through 26 is sealed therein. The temperature of molten aluminum metal or alloy 33 preferably is maintained in the holding chambers 19 and 19' by the use, as illustrated in FIG. 1, of one or more natural gas or other combustion fuel burners 36 and 36' associated with the holding chambers 19, 19'. For example, a pair of burners 36 and 36' can be provided for heating melt in each holding chamber 19, 19' as shown. However, this melt temperature control may be accomplished with electric radiant heat, immersion tube heaters, or other heaters.

Additional pass-through passages 35 and 35' located at the floor level of the holding chambers 19, 19' allow the individual molten metal or alloy 33 to pass into separate, isolated take-out wells 21, 21' where the metal or alloy may be further processed, treated and/or removed by ladle or pump or by tapping ports 22 located just above floor level as shown in FIGS. 1–2 or other molten metal or alloy removal access, all without contact of the different metals or alloys to avoid metallurgical contamination. A drain tap 23 located at floor level in each take-out well 21, 21' provides a means for completely removing the molten metal or alloy 33 from the holding chambers 19, 19' of the furnace 10. A refractory lined access door 19A can be provided on the furnace to provide access to the interior thereof for cleaning and other maintenance.

In operation of the furnace 10 described above that is already hot as a result of prior use, the door 17 providing access to the primary melting chamber 11 is opened by fluid cylinder HC1 (or other actuator) to allow the floor of the primary melting chamber 11 to be manually scraped to remove any slag or potential contaminants from the previous melt if it comprised a different metallurgical alloy. Refractory plug 30 is manually positioned in one of the pass-through passages 26 or 26' to allow molten metal flow only through the unplugged pass-through (for example passthrough passage 26' in FIG. 2). The solid metal charge material 34 now is placed on the floor of the primary melting chamber 11, and the charging door 17 is closed by fluid cylinder HC1 (or other actuator). For purposes of illustration only, the solid metal charge material 34 can comprise a large stack of aluminum or aluminum alloy ingots or sows (not shown) placed in the primary melting chamber 11 by a forklift, mechanized loader device, or in any other manner.

The door 18 providing access to the secondary melting chamber 12 now is opened by fluid cylinder HC2 (or other actuator) to allow the refractory floor of the melting chamber 12 to be manually scraped to remove any slag or potential contaminants from the previous melt if it comprised a different metallurgical alloy. The solid metal charge 34' now is placed on the floor of the secondary melting chamber 12 by a fork lift, mechanized loader device, or in any other manner, and the charging door 18 is closed by fluid cylinder HC2 (or other actuator). The solid metal charge material 34' typically comprises aluminum or aluminum alloy gates, risers, and returns from previous casting operations and typically of the same or similar composition as solid material 34.

The charge materials 34, 34' then are simultaneously melted in chambers 11, 12 by firing burners 13, 13' such that combustion heat circulates through the solid charge material 34 in the primary melt chamber 11 and then is forced to enter the bottom pass-through passage 25 and into the secondary melt chamber 12. The combustion heat rises through the charge material 34' in the secondary melting chamber 12 to provide secondary melting and more efficient use of the energy. The molten metal flows into the holding chamber 19 or 19' which is connected to the melting chamber 11 via the unplugged pass-through passage 26, 26'.

Before, during and after melting of the charge materials 34, 34' in chambers 11, 12, operating personnel can further process, remove and use molten metal or alloy from the individual molten metal-filled take-out well 21 or 21' since the melt holding function of the take-out wells is separate and independent from the charge heating/melting that occurs in chambers 11, 12.

The invention is advantageous in allowing for the sequential melting and simultaneous holding, storage and use of a plurality of molten metals or alloys in a single furnace without metallurgical contamination. For example, a particular aluminum alloy first can be melted in chambers 11, 12 and then directed into one of the holding chambers 19 or 19' and associated tapping well 21 or 21'. Then a second aluminum alloy with a different alloy composition can be melted in chambers 11, 12 and then directed into the other of the holding chambers 19 or 19' and associated take-out well 21 or 21' with the different molten alloys maintained out of contact with one another to avoid alloy contamination.

While an illustrative embodiment of the invention is described above and shown in the drawings, the invention is not intended to be limited thereto. For example, a single furnace 10 as illustrated and described could be employed with more than two molten metal holding chambers 19 and 19'. In this case the pass-through passages 26 and 26', the refractory dividing wall 24, and the holding chambers 19 and 19' would be sized and arranged to accommodate the sequential melting and simultaneous holding and use of more than two alloys. A further possible modification includes two or more primary melt chambers 11 and secondary melt chambers 12 connected to larger capacity multiple holding chambers to allow even greater flexibility in sequentially melting and simultaneously holding and using different aluminum or other alloys without contamination.

Additionally, while the invention has been previously described as an aluminum melting furnace 10, it also may be used in melting a wide variety of other metal alloys that may lend themselves to this type of processing. Likewise, while the furnace 10 has been described as using a fossil fuel energy source as the main energy supply, it may also be modified to use electrical energy, or any combination of electrical and fossil fuel energy available. Accordingly, while the invention has been described in connection with a particular preferred embodiment thereof, the invention is not to be limited thereby and instead is defined as set forth by the claims that follow.

We claim:

1. A melting furnace for melting and holding a plurality of molten metals of different composition, comprising a melting chamber, a plurality of elongated molten metal holding chambers disposed side-by-side and communicated to said melting chamber by a respective molten metal pass-through passage extending through a common wall connecting said chamber and said holding chambers for communicating said melting chamber to a respective holding chamber for holding a respective molten metal therein, said wall forming respective ends of said holding chambers, said holding chambers being separated from one another by partition means to thereby eliminate contact between the molten metals therein, and means for selectively communicating said melting chamber in melt flow relation to a respective pass-through passage and associated holding chamber so as to introduce said respective molten metal into the associated holding chamber.

2. The furnace of claim 1 wherein each said holding chamber includes a take-out well that receives molten metal from the holding chamber for further processing or removal without contact with other molten metals in other holding chambers.

3. The furnace set forth in claim 1 wherein a combustion burner device in the melting chamber is fired directly at a removable refractory lined access door to said melting chamber.

4. The furnace as set forth in claim 3 wherein the primary melting chamber is communicated to first and second holding chambers separated and isolated from one another by a partition wall via individual first and second pass-through passages extending side-by-side through said wall.

5. The furnace set forth in claim 1 wherein said means comprises a refractory plug positioned in one of said pass-through passages to partially close off a lower region of said one of said pass-through passages to flow of molten metal while leaving an upper region thereof open to communicate to said melting chamber, said plug permitting flow of molten metal from the melting chamber through the unplugged one of said pass-through passages into a respective holding chamber communicated to said unplugged pass-through passage.

6. The furnace set forth in claim 1 wherein said primary melting chamber and said secondary melting chamber have a respective primary chamber access door and a secondary chamber access door mounted on the exterior of said furnace so that solid metallic ingots or sows can be charged into the primary chamber and additional metallic charge material can be charged into the secondary chamber.

7. A refractory lined metal melting furnace for the melting and holding of first and second molten metals of different composition, comprising a melting chamber, a first pass-through passage communicating said melting chamber to an adjoining first refractory-lined, heated holding chamber for holding the first molten metal therein, a second pass-through passage communicating said melting chamber to an adjoining second refractory-lined, heated molten metal holding chamber for holding the second molten metal therein, said first and second holding chambers being disposed side-by-side and said first and second pass-through passages extending side-by-side through a common wall connecting said melting chamber and both said first and second holding chambers, said wall forming respective ends of said first and second holding chambers, means for alternately communicating said melting chamber in melt flow relation to one of said first and second pass-through passages so that one holding chamber at a time is communicated for melt flow to said melting chamber, said first and second holding chambers being separated from one another by a refractory partition to thereby eliminate contact between the first molten metal and the second molten metal, said first and second holding chambers being communicated to respective first and second take-out wells where each respective molten metal is received without contact with the other for further processing or removal.

8. The furnace set forth in claim 7 wherein a combustion burner device in the melting chamber is fired directly at a removable refractory lined access door to said melting chamber.

9. A method of melting and holding a plurality of molten aluminum alloys of different composition, comprising melting a first aluminum alloy having a first composition in a melting chamber, directing the melted first aluminum alloy through one of a plurality of molten metal pass-through passages extending through a common wall between the melting chamber and a respective one of a plurality of heated molten metal holding chambers into said respective one of said plurality of heated molten metal holding chambers, holding the melted first aluminum alloy in said one holding chamber, melting a second aluminum alloy of different composition in the melting chamber, directing the melted second aluminum alloy through another of said plurality of molten metal pass-through passages into another of the plurality of heated molten metal holding chambers, and holding the melted second aluminum alloy in said another holding chamber separated from said melted first aluminum alloy held in said one holding chamber.

10. The method of claim 9 including independently further processing or removing the melted first aluminum alloy and the second aluminum alloy in respective isolated take-out wells associated with said one holding chamber and said another holding chamber.

11. A melting furnace for melting and holding a plurality of molten metals of different composition, comprising a primary melting chamber connected by a bottom pass-through passage to a secondary melting chamber such that combustion heat in said primary chamber melting chamber is forced to circulate through a solid metallic charge in said primary melting chamber and enter said bottom pass-through passage into said secondary melting chamber for heating an additional solid metal charge therein, a plurality of molten metal pass-through passages each communicating said melting chamber to a respective heated molten metal holding chamber for holding a respective molten metal therein, said holding chambers being separated from one another by partition means to thereby eliminate contact between the molten metals therein, and means for selectively communicating said melting chamber to a respective pass-through passage and associated holding chamber so as to introduce said respective molten metal into the associated holding chamber.

12. The furnace of claim 11 wherein a combustion burner in said melting chamber is fired directly at a removable refractory lined access door.

13. The furnace of claim 1 further including a secondary melting chamber communicated to said melting chamber by a pass-through passage in another wall of said chamber opposite from said wall.

14. A melting furnace for melting and holding a plurality of molten metals of different composition, comprising a melting chamber having a combustion burner fired directly at a removable refractory lined access door, a plurality of molten metal passthrough passages each communicating said melting chamber to a respective molten metal holding chamber for holding a respective molten metal therein, said holding chambers being separated from one another by a partition to thereby eliminate contact between the molten metals therein, and means for selectively communicating said melting chamber to a respective pass-through passage and associated holding chamber so as to introduce said respective molten metal into the associated holding chamber.

* * * * *